United States Patent [19]

Masubuchi et al.

[11] Patent Number: 4,888,244

[45] **Date of Patent: * Dec. 19, 1989**

[54] PROCESS FOR FORMING COMPOSITE COATED FILM

[75] Inventors: Yoichi Masubuchi; Tadashi Watanabe; Akira Tominaga; Haruo Nagaoka; Eisaku Nakatani; Masafumi Kume, all of Hiratsuka, Japan

[73] Assignee: Kansai Paint Co., Ltd., Hyogo, Japan

[ * ] Notice: The portion of the term of this patent subsequent to Aug. 2, 2005 has been disclaimed.

[21] Appl. No.: 905,454

[22] Filed: Sep. 10, 1986

[30] Foreign Application Priority Data

Sep. 10, 1985 [JP] Japan ..... 60-199709

[51] Int. Cl.[4] ..... C25D 13/06

[52] U.S. Cl. ..... 428/416; 204/181.1; 204/181.7; 427/407.1; 427/409; 427/410

[58] Field of Search ..... 204/181.1, 181.7; 428/413, 414, 416, 418; 427/407.1, 409, 410

[56] References Cited

U.S. PATENT DOCUMENTS

| | | | |
|---|---|---|---|
| 3,998,716 | 12/1976 | Masar et al. | 204/181.1 |
| 4,375,498 | 3/1983 | LeMinez et al. | 204/181.1 |
| 4,419,467 | 12/1983 | Wisner et al. | 204/181.7 |
| 4,456,507 | 6/1984 | Kivel et al. | 204/181.1 |
| 4,619,746 | 10/1986 | Delaney et al. | 204/181.1 |
| 4,761,212 | 8/1988 | Watanabe | 204/181.1 |

*Primary Examiner*—John F. Niebling
*Assistant Examiner*—Ben C. Hsing
*Attorney, Agent, or Firm*—Wenderoth, Lind & Ponack

[57] ABSTRACT

A process for forming a composite coated film, which comprises coating a cationically electrodepositing paint composed mainly of a cationic resin having a functional group capable of reacting with isocyanate groups on the surface of a substrate, then coating an organic solvent-base paint containing a polyisocyanate compound and capable of forming a coated film having a static glass transition temperature of 0° to −75° C. on the surface of the electrodeposited paint film, and then coating a top coat paint.

23 Claims, No Drawings

PROCESS FOR FORMING COMPOSITE COATED FILM

This invention relates to an improvement in a process for forming a composite coated film composed of a cationically electrodeposited film, an intermediate coated film (sometimes omitted) and a top coated film, and more specifically, to a process for forming a composite coated film having improved chipping resistance and corrosion resistance in which the cationically electrodeposited film can be cured at a low temperature (not more than about 130° C.).

A cationic electrodeposition paint is used in an electrodeposition coating process which uses an article to be coated as a cathode. Since it does not cause dissolution of the substrate metal or the chemically treated coating during electrodeposition, the resulting coated film has better corrosion resistance and alkali resistance than an anionic electrodeposition paint. Hence, the cationic electrodeposition paint is extensively used in the field of automotive bodies and parts, electrical appliances, and building materials by further applying an intermediate coating paint and a top coating paint.

The cationic electrodeposition coating contains a thermosetting resin as a main component, and a coated film having practical properties cannot be obtained unless the applied coating is baked at a high temperature of usually at least 160° C. Accordingly, the use of cation electrodeposition paints has the defect that expenditures required to maintain baking facilities and temperatures become enormous.

In recent years, exterior metallic plates of automobilies, bicycles, electrical appliances, etc. have been replaced partly by plastics such as polypropylene, ABS resin, urethane resin, and nylon. Desirably, such objects are coated by an electrodeposition coating-intermediate coating-top coating process after the metallic part and the plastic part have been bonded and integrated into a finished object because it saves work in the coating process and applies top coats of the same color to both parts. However, the baking temperature of the cationically electrodeposited film is higher than the heat distortion temperature (at least about 130° C.) of the plastics, and it is difficult to effect coating after the metallic and plastic parts have been integrated. It has been desired therefore to develop a method of curing the cationically electrodeposited film at a temperature of not more than about 130° C.

In the automobile industry, with regard to chipping resistance, a problem of the durabllity of coatings, particularly the reduction of the corrrosion resistance of the coatings and the progress of corrosion of steel material owing to impact peeling, has been important. In particular, in districts of cold climate in Europe and U.S.A., it is frequently the practice to spread gravel containing large amounts of relatively coarse particles of rock salt on roads to prevent freezing. Automobiles running on roads of this kind undergo collision at their coated surface with rock salt particles of pebbles scattered by their wheels. This frequently causes "chipping" which is an impact peel phenomenon whereby the coatings are locally peeled by the impact of collision. As a result, the metallic substrate surface of the part of collision on the exterior plates are exposed and rust and corrosion proceed rapidly. It is usually known that peeling of the coatings by chipping frequently occurs at the bottom of the body and parts near the wheels but it also occurs in hoods and roofs, and in about half a year to one year, local corrosion becomes considerably remarkable.

In order to prevent chipping and consequent corrosion, extensive investigations have previously been made on the chemical treatment of the surface of an exterior metallic substrate of automotive bodies, electrodeposition paints, intermediate coating paints and top coating paints, but no specific measure which solves this problem has been found.

It is an object of this invention to provide a process for forming a composite coated film composed of a a cationically electrodeposited paint, an intermediate coated film (which may sometimes be omitted) and a top coat film, in which the cationically electrodeposited film can be cured at low temperatures and the chipping resistance and corrosion resistance of the resulting composite coated film are improved.

It has been found that the above object of the invention is achieved by using a paint composed mainly of a cationic resin having a functional group capable of reacting with isocyanate groups as the cationically electrodepositing paint, and applying an organic solvent-base paint comprising a polyisocyanate compound and being capable of forming a coated film having a static glass transition temperature of 0° to −75° C. to the surface of the cationically deposited film prior to coating an intermediate coating paint or a top coating paint.

According to this invention, there is provided a process for forming a composite coated film, which comprises coating a cationically electrodepositing paint composed mainly of a cationic resin having a functional group capable of reacting with isocyanate groups on the surface of a substrate, then coating an organic solvent-base paint containing a polyisocyanate compound and having capable of forming a coated film having a static glass transition temperature of 0° to −75° C. on the surface of the electrodeposited paint film, as required coating an intermediate coating paint, and then coating a top coat paint.

The characteristic feature of this invention is that (1) a cationically electrodeposited film composed mainly of a cationic resin having a functional group capable of reacting with isocyanate groups (to be abbreviated as "cationic base resin") is formed; and then (2) an organic solvent-base paint containing a polyisocyanate compound and being capable of forming a coated film having a static glass transition temperature (Tg) of 0° to −75° C. (to be referred to as the "barrier coat") on the surface of the electrodeposited film prior to coating the intermediate coating paint and a top coating paint.

In regard to the characteristic (1), a conventional cationic electrodepositing paint usually contains a cationic resin (base resin) and a blocked polyisocyanate compound (crosslinking agent) as main components. A coated film electrodeposited from this paint is usually heated to a temprarture above about 160° C. dissociate the blocking agent of the blocked polyisocyanate compound, and the regenerated polyisocyanate compound reacts with the cationic resin and cures with crosslinkage. In contrast, the cationic base resin used in the cationic elecrodepositing paint used in the invention is composed mainly of a cationic base resin and does not substantially contain a crosslinking agent such as a blocked polyisocyanate. Hence, a coated film deposited from the cationic electrodepositing paint alone never cures alone. However, as described in the characteristic (2) of the present invention, when the barrier coat is applied to the coated surface of the electrodeposited film, the polyisocyanate compound contained in the barrier coat penetrates into the electrodeposited coated film and reacts with the functional group of the cationic base resin to cure the base resin. Since the polyisocyanate compound is not blocked, this curing reaction proceeds easily even at low temperatures of less than about 130° C., and the coated film cures at ordinary temperatures. According to the process of this invention, the cationically electrodeposited film can be cured three-dimensionally at a temperature of as low as not more than about 130° C. Since the properties of the cured film are equivalent to, or better than, that obtained by high-temperature heating described above, the facilities and maintenance are simplified, and for example, on a unitary strucure of a plastic and a metallic material, the electrodeposited film can be cured without thermally deforming the plastic material.

With regard to the characteristic (2), the barrier coat having a static glass transition temperature of 0° to −75° C. is more flexible than an intermediate coated film intended to imrove chipping resistance. When rock salt partricles or crushed stones collide with the surface of a top coat formed via the barrier coat having such a physical property with strong impact forces, the impact energy is mostly or wholly absorbed by the barrier coat and does not spread to the electrodeposited film below it. In addition, the top coat itself hardly undergoes physical damage. In other words, the barrier coat layer serves as a buffering layer for an external impact force, and greatly contributes to marked improvement of the chipping resistance of the resulting composite coated film and to prevention of rust and corrosion of the steel material by chipping. It is also useful for preventing degradation of the top coat by collision of rock salt particles and crushed stones.

The coating process of this invention will be described more specifically below.

Substrate

The substrate may be any of elecricall conductive substrates on which a composite coated film can be formed by the process of this invention and which have a metallic surface that can be cationically electrodeposition-coated. For example, the substrate is made of iron, copper, aluminum, tin, zinc, alloys containing such metals, or substrates plated, or vacuum-deposited from these metals or alloys. Specifically, the substrate includes bodies and parts of automobiles, trucks, safari cars and autocycles, electrical appliances, and building materials. Preferably, these substrates are chemically treated with phosphate salts or chromate salts prior to coating the cationically electrodepositing paint.

Cationically electrodepositing paint

This is a paint having excellent corrosion resistance which is applied to the surface of the substrate. It comprises a cationic resin (to be referred to sometimes as the "cationic base resin") having a functional group capable of reacting with isocyanate groups as a main vehicle component and is substantially free from a cross-linking agent such as a polyisocyanate compound or a blocked polyisocyanate compound.

The term "functional group" capable of reacting with isocyanate groups", as used herein, denotes a functional group containing active hydrogen such as a hydroxyl group (—OH), a primary amino group (—$NH_2$), or an imino group (>NH).

The term "cationic resin", as used herein, denotes a resin used for cathode-depositing electrodeposition, which is, for example, a resin mainly containing a basic amino group or an onium base.

Generally, resins obtained by reacting epoxy resins with cationizing agents are suitable as cationic base resins having excellent corrosion resistance and containing functional groups capable of reacting with isocyanate groups.

Preferred epoxy resins include, for example, those obtained by the reaction of polyphenolic compounds with epichlorohydrin. Examples of the polyphenolic compounds are bisphenols such as bis(4-hydroxyphenyl)methane, bis(4-hydroxyphenyl)1,1-ethane and bis(4-hydroxyphenyl)2,2-propane; phenol novolak and cresol novolak.

In the present invention, epoxy resins obtained by reacting these polyphenolic compounds with epichlorohydrin can be used as such. It is, however, preferred to use high-molecular-weight epoxy resins obtained by further reacting these epoxy resins with bisphenols. There can also be used addition-reaction products of these epoxy resins with polyols (such as ethylene glycol, 1,6-hexanediol and pentaerythritol), polyether polyols, polyester polyols, polyamideamines, polycarboxylic acids, polyisocyanates, etc. Products obtained by graft-copolymerizing the above epoxy resins with epsilon-caprolactone, acrylic (methacrylic) monomers, etc. may also be used. Furthermore, these epoxy resins may be used as mixtures with other epoxy resins such as alicyclic or aliphatic epoxy resins, glycidyl group-containing acrylic resins and epoxidized poybutadiene.

The above epoxy resins desirably have a number average molecular weight of generally 300 to 5,000, especially 1,000 to 3,000, and en epoxy equivalents of generally 150 to 3,000, especially 500 to 2,000.

Of these, resins obtained by the reaction of bis(4-hydroxyphenyl)-2,2-propane or phenol novolak with epichlorohydrin are preferred.

Examples of the cationizing agents to be reacted with the above epoxy resins are basic amino compounds such as aliphatic, alicyclic or aromatic-aliphatic primary or secondary amines, tertiary amine salts, secondary sulfide salts and tertiary phosphine salts.

Of these, the basic amino compounds are preferred. Typical examples are given below.

(1) Primary or secondary amines of the following formula

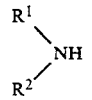

(I)

wherein each of $R^1$ and $R^2$ represents a hydrogen atom, an alkyl group or a hydroxyalkyl group, with the proviso that $R^1$ and $R^2$ do not simultaneously represent a hydrogen atom.

Specific examples include alkylamines such as methylamine, ethylamine and n- or iso-propylamine, alkanolamines such as monoethanolamine and n- or iso-propanolamine, dialkylamines such as diethylamine; dialkanolamines such as diethanolamine and di-n- or iso-propanolamine, and N-alkylalkanolamines such as N-methylethanolamine and N-ethylethanolamine.

(2) Polyamines represented by the following formula

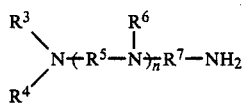

(II)

wherein each of $R^3$ and $R^4$ represent a hydogen atom, an alkyl group or a hydroxyalkyl group, each of $R^5$ and $R^7$ represents an alkylene group, $R^6$ represents a hydrogen atom or an alkyl group, and n is 0 or an integer of 1 to 10.

Specific examples include ethylenediamine, diethylenetriamine, hydroxyethylaminoethylamine, ethylaminoethylamine,methylaminopropylamine, dimethylaminoethylamine, and dimethylaminopropylamine.

(3) Other basic amine compounds such as ammonia, hydroxylamine, hydrazine, and hydroxyalkylhydrazine such as hydroxyethylhydrazine.

In formulae (I) and (II), the alkyl, hydroxyalkyl and alkylene groups may be linear or branched, and are preferably lower.

The term "lower", as used in the present specification and the appended claims, means that a group (or an atomic grouping) or a compound qualified by this term has not more than 6, preferably not more than 4, carbon atoms.

Preferred among the above basic amino compounds are lower alkanolamines, di-lower alkanolamines, and N-lower alkyl-lower alkanolamines. Especially preferred basic amino compounds are monoethanolamine, diethanolamine, N-methyl-ethanolamine and N-ethyl-ethanolamine.

Such basic amino groups, after being introduced into epoxy resins, are cationized by neutralization with acids.

The cationizing agents include, for example, tertiary amine salts, secondary sulfide salts and tertiary phosphine salts include compounds represented by the following formulae.

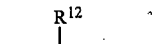

(III)

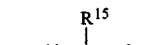

(IV)

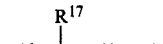

(V)

In the formulae, each of $R^{11}$, $R^{12}$ and $R^{13}$ represents a lower alkyl group or a lower hydroxyalkyl group, each of $R^{14}$ and $R^{15}$ represents a lower alkyl group, a lower hydroxyalkyl group or an aryl group (such as a phenyl group), or $R^{14}$ and $R^{15}$ together form a lower alkylene group, each of $R^{16}$, $R^{17}$ and $R^{18}$ represents a lower alkyl group or an aryl group (especially a phenyl group), $HA^1$ represents an organic acid, and $HA^2$ represents an inorganic or organic acid.

Specific examples of the tertiary amine salts, secondary sulfide salts and tertiary phosphine salts include the following compounds.

(i) Tertiary amine salts such as salts of tertiary amines such as triethylamine, triethanolamine, N,N-dimethylethanolamine, N-methyldiethanolamine, N,N-diethylethanolamine and N-ethyldiethanolamine with organic acids such as formic acid, acetic acid, propionic acid, butyric acid and lactic acid.

(ii) Secondary sulfide salts, such as salts of secondary sulfides such as diethyl sulfide, thiodiethanol, diphenyl sulfide ad tetramethylene sulfide with inorganic acids such as boric acid and carbonic acid or the aforesaid organic acids.

(iii) Tertiary phosphine salts, such as salts of tertiary phosphines such as triethylphosphine, phenyldimethylphosphine, diphenylmethylphosphine and triphenylphosphine with the aforesaid inorganic or organic acids.

The following methods may, for example, be used to modify the epoxy resins with the cationizing agents to form the cationic base resins.

(a) The basic amino compound is reacted with the epoxy groups in the epoxy resin, and then the reaction product is protonized with an organic acid such as formic acid, acetic acid, propionic acid, butyric acid or lactic acid to form a cationic base resin.

The reaction of the epoxy resin with the basic amino compound may be carried out generally in a suitable reaction medium at a temperature of 40° to 140° C. using 0.1 to 1.0 mole of the basic amino compound per epoxy group of the epoxy resin.

Where the basic amino compound contains a primary amino group, it is possible to block the primary amino group by reaction with a ketone compound such as methyl isobutyl ketone, methyl ethyl ketone or ethyl butyl ketone (ketiminization), and then to react the remaining active hydrogens (hydrogens in functional groups such as >NH, —OH or —SH) with the epoxy groups.

The amount of the organic acid used in protonizing the basic amino group so introduced into the epoxy resin is suitably about 0.3 to 0.6 times the neutralization equivalent weight based on the base value (generally in the range of about 20 to 2000) of the reaction product between the epoxy resin and the basic amino compound.

The term "basic value", as used herein, denotes the equivalent of HC1 required to neutralize one gram of the resin which is converted into the milligrams of KOH.

An alternative method of introducing the basic amino group into the epooxy resin comprises reacting a tertiary aminomonoisocyanate obtained from a tertiary aminoalcohol such as triethanolamine or N,N-dimethylethanolamine and a diisocyanate such as hexamethylene diisocyanate or tolylene diisocyanate with the hydroxyl groups of the epoxy resin. The epoxy resin into which the tertiary amino group has been introduced is protonized with the organic acid as above to form a cationic base resin.

(b) The tertiary amine salt, secondary sulfide salt or tertiary phosphine salt is reacted with the epoxy groups of the epoxy resin to introduce a quaternary ammonium salt group

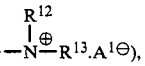

(such as $R^{11}-\overset{R^{12}}{\overset{|}{N}}{}^{\oplus}-R^{13}.A^{1\ominus}$), a tertiary sulfonium salt group

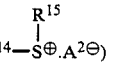

(such as $R^{14}-\overset{R^{15}}{\overset{|}{S}}{}^{\oplus}.A^{2\ominus}$)

or a quaternary phosphonium salt group $$\text{(such as } R^{16}-\overset{R^{17}}{\overset{|}{P}}{}^{\oplus}-R^{18}.A^{2\ominus}\text{).}$$

In the present invention, the cationically electrodeposited film cures by crosslinking reaction with the polyisocyanate compound contained in the barrier coat to be applied thereto. Since the barrier coat is usually coated by a spray coating machine or an electrostatic coating machine, the coating efficiency is inferior to cationic electrodeposition, and sometimes the surface of the electrodeposited film remains uncoated with the barrier coat. Accordingly, the cationic electrodepositing paint used in this invention is preferably one which without the application of the barrier coat, melts and flows by being heated to a relatively low temperature (less than about 130° C., preferably 60° to 120° C.) a coated film having excellent mechanical properties and corrosion resistance. To provide such a cationic electrodepositing paint, the cationic base resin preferably has a static glass transition temperature (Tg) of generally 50 to 130° C., particularly 70° to 120° C., and a number average molecular weight of generally about 3,000 to 30,000, especially 5,000 to 15,000.

As functional groups capable of reacting with isocyanate groups in the cationic base resin, the hydroxyl group is naturally introduced in the step of reacting the epoxy resin with the cationizing agent to include a cationic group, and the amino group and the imino group can necessarily be introduced in the step of reacting the epoxy resin with the basic amino compound. The content of these functional groups in the cationic base resin is 1 to 20 equivalents, preferably 1 to 15 equivalents, especially 2 to 10 equivalents, per 1000 g of the resin.

The content of cationic groups in the cationic case resin is such that the resin disperses or dissolves stably in water, and in terms of a base value, it is preferably about 3 to 30, particularly 5 to 15. But even if the content of cationic groups is less than 3, the resin can be dispersed in water by utilizing a surfaceactive agent or the like.

The cationic electrodepositing paint used in this invention is composed basically of a solution or dispersion of the cationic base resin in an aqueous medium (water or a mixture of water and a minor proportion of a water-miscible organic solvent). If required, however, it may further include a urethanization catalyst, an anphipathic organic solvent, a pigment (a colored pigment, a body extender pigment, an anticorrosive pigment, etc.), etc.

The urethanization catalyst is effective for rapidly accelerating the crosslinking curing reaction of the polyisocyanate compound permeated from the barrier coat and the functional groups of the cationic base resin in the electrodeposited film. Desirably, it does not adversely affect electrodeposition, nor does it become inactivated by decomposition in the presence of water and acids. Examples of the urethanization catalyst include triethylenediamine, hexamethylenetetramine, tin octenoate, dibutyltin oxide, dioctyltin oxide, dibutyltin di(2-ethylhexoate), lead 2-ethylhexoate, bismuth nitrate, tetra(2ethylhexyl) titanate, lead acetate, lead silicate, lead oxide, ferric hydroxide, iron 2-ethylhexoate, cobalt 2-ethylhexoate, zinc naphthenate, 1,8-diazabicyclo-[5,4,0]undecane phenolate, octylate or oleate, manganese naphthenate, di-n-butyltin dilaurate, tetra-n-butyltin, 2-ethylhexyl titanate, copper naphthenate, nickel naphthenate, and cobalt naphthenate. They may be used either singly or in combination. Of these, the lead or tin compounds are preferred. The amount of the urethanization catalyst to be included is preferably 0.05 to 5 parts by weight, especially 0.1 to 2.5 parts by weight, per 100 parts by weight of the cationic base resin.

The anphipathic organic solvents is watersoluble and has good affinity for the cationic resin and the vehicle component of the barrier coat. Examples include ethylene glycol monobutyl ether, butyl carbitol and methyl ethyl ketone. This solvent is effective for increasing the affinity between the cationically electrodeposited film and the barrier coat film, and is preferably used in an amount of 10 to 100 parts by weight per 100 parts by weight of the cationic base resin.

Examples of the pigment are colored pigments such as titanium white, carbon black, red iron oxide, and basic lead chromate; body extender pigments such as asbestine, clay, talc, barium carbonate and bentonite; and anticorrosive pigments such as zinc chromate, strontium chromate, barium chromate, calcium chromate, basic lead sulfate, barium meta-borate and zinc molybdate.

The amount of the pigment to be included is preferably not more than 100 parts by weight, especially 20 to 60 parts by weight, per 100 parts by weight of the cationic base resin. If it is incorporated in an amount of 20 to 40 parts by weight, a thick composite coated film can be formed also in acute-angled parts of an object (steel material) to be coated, and the corrosion resistance and chipping resistance of these parts can be improved.

The cation electrodepositing paint used in this invention may be coated on the surface of a substrate by ordinary methods. For example, the elecrodepositing paint is diluted with, for example, deionized water to a solids concentration of about 5 to about 40% by weight, and its pH is adjsuted to a value within the range of 5.5 to 8.0. Then, the paint may be applied to the substrate used as a cathode usually at a bath temperature of 15 to 35 C and a loaded voltage of 100 to 400 V. The thickness of the electrodeposited film is not particularly restricted, but is generally preferably within the range of 10 to 40 microns after curing.

Barrier coat

The barrier coat is applied to the surface of the cationically electrodeposited film as an intermediate buffering layer which absorbs the energy of impact that occurs upon collision of rock salt particles, etc. In the present invention, it is an organic solvent-base paint containing the polyisocyanate compound and capable of forming a coated film having a Tg of 0° to −75° C.

The barrier coat used in this invention is composed of the polyisocyanate compound, a vehicle component and an organic solvent as main components. If required, it may further include a tackifier, a pigment (e.g., a colored pigment, a body extender pigment or an anticorrosive pigment), an ultraviolet absorber, a light stabilizer, an oxidation inhibitor, a urethanization catalyst, etc.

The polyisocyanate compound to be included in the barrier coat used in this invention is a compound having per molecule at least 2, preferably 2 to 4, free isocyanate groups (NCO) which may partly or wholly be blocked with a blocking agent capable of being dissociated at a temperature of not more than about 130° C., preferably 60° to 120° C.

The compound having at least two free isocyanate groups per molecule may be aliphatic, alicyclic, aromatic or aromatic-aliphatic. Specific examples include tolylene diisocyanate, 4,4'-diphenylmethane diisocyanate, xylylene diisocyanate, meta-xylylene diisocyanate, trimethylhexamethylene diisocyanate, 4,4'-methylenebis(cyclohexylisocyanate), 1,3-(isocyanatemethyl)cyclohexane, hexamethylene diisocyanate, lysine diisocyanate, hydrogenated 4,4'-diphenylmethane diisocyanate, hydrogenated tolylene diisocyanate, isophorone diisocyanate, trimethylhexamethylene diisocyanate, dimeric diisocyanate, tolylene diisocyanate (3 moles)/trimethylolpropane (1 mole) adduct, tolylene diisocyanate polymer, hexamethylene diisocyanate (3 moles)/trimethylolproane (1 mole) adduct, the reaction product of hexamethylene diisocyanate and water, xylylene diisocyanate (3 moles)/trimethylolpropane (1 mole) adduct, and tolylene diisocyanate (3 moles)/hexamethylene diisocyanate (2 moles) adduct. They may be used either singly or in combination. Among these polyisocyanate compounds, the hexamethylene diisocyanate/water reaction product, xylylene diisocyanate/trimethylolpropane adduct, tolylene diisocyanate/hexamethylene diisocyanate adduct, isophorone diisocyanate, hexamethylene diisocyanate and lysine diisocyanate are preferred.

The blocking agent capable of being dissociated at a low temperature of not more than about 130° C. may, for example, be methyl ethyl ketoxime, malonic esters and acetylacetone. The polyisocyanate compound may be blocked with such compounds by methods known per se.

The vehicle component that can be used in the barrier coat may be any thermoplastic or thermosetting resin capable of forming a coated film which has good adhesion to the electrodeposited film and an intermediate coated film and a top coat film to be described hereinbelow and has a Tg of 0° to −75° C., preferably −35° to −60° C., more preferably −40° to −55° C. Specific examples are given below. It should be understood however that these are merely illustrative, and the vehicle component that can be used in this invention should not be limited to them alone.

(1) Vinyl acetate/ethylene copolymer

Vinyl acetate/ethylene copolymers obtained by copolymerizing in a customary manner about 5 to about 70% by weight, preferably 15 to 50% by weight, of vinyl acetate and about 95 to about 30% by weight, preferably 85 to 50% by weight, of ethylene. Preferably, these copolymers have a number average molecular weight of generally about 5,000 to about 500,000, especially 10,000 to 300,000.

(2) Linear saturated polyester resins

Linear thermoplastic polyesters substantially free from a branched structure and obtained by polycondensing saturated dibasic acids containing 2 carboxyl groups per molecule and being free from a polymerizable unsaturation and dihydric alcohols being free from a polymerizable unsaturation in a customary manner.

The dibasic acids are preferably aliphatic saturated dibasic acids having 4 to 34 carbon atoms such as succinic acid, glutaric acid, adipic acid, pimelic acid, cork acid, azelaic acid, and brassylic acid. These saturated dibasic acids may be used in combination with aromatic or alicyclic dibasic acids such as phthalic anhydride, tetrahydrophthalic anhydride, and hexahydrophthalic anhydride. As the dihydric alcohols, linear aliphatic alcohols such as ethylene glycol, diethylene glycol, triethylene glycol, 1,4-butylene glycol 1,6hexanediol, 1,5-pentanediol and propylene glycol are especially preferably used. Furthermore, as required, 2,3-propylene glycol, neopentyl glycol and 1,3-butylene glycol may be used. The polyester resins preferably have a number average molecular weight of generally in the range of about 10,000 to about 100,000, especially 20,000 to 80,000.

(3) Thermoplastic polyurethane elastomers

Resins obtained by reacting diol compounds containing hydroxyl groups at both ends and having a molecular weight of about 500 to about 4,000 with diisocyanate compounds, thereby to extend the chain length of the diol compounds to 2 to 50 times the original length. Examples of the diol compounds are OH-terminated polyesters derived from dibasic acids and dihydric alcohols described in (2) above, polypropylene glycol, addition polymerization products of triols (such as glycerol, hexanetriol or trimethylolpropane) and propylene oxide, ethylene oxide/propylene oxide copolymer, polyethylene glycol, and polytetramethylene glycol. The diisocyanate may preferably be selected from the examples of the polyisocyanate compounds which are given hereinabove.

(4) Crosslinkable resin composition containing polybutadiene

A crosslinkable composition comprising polybutadiene containing a functional group selected from primary and secondary amino groups, a hydroxyl group and a carboxyl group introduced into its both ends and having a number average molecular weight of about 10,000 to about 1,000,000, especially 20,000 to 300,000, or butadiene/acrylonitrile copolymer having an acrylonitrile content of about 1 to about 50% by weight and a number average molecular weight of about 10,000 to about 1,000,000, especially 20,000 to 300,000, and at least one resin as a crosslinking agent selected from epoxy resins, urethane resins, polyester resins and melamine resins. The proportions of the polybutadiene or butadiene/acrylonitrile copolymer and the crosslinking agent in the composition are not strictly limited. Generally, the suitable proportion of the crosslinking agent is about 10 to about 60 parts by weight, especially 20 to 50 parts by weight, per 100 parts by weight of polybutadiene or the butadiene/acrylonitrile polymer. Depending upon the type of the crosslinking agent, the composition undergoes crosslinking reaction and cures at room temperature or under heat. It is easy to form a barrier coat film having the aforesaid Tg by properly selecting the molecular weight of the polybutadiene or its copolymer, the type and amount of the crosslinking agent, etc. in the preparation of the barrier coat using the above composition.

(5) Thermosetting polyester resin composition

Mixtures obtained by esterifying acid components composed mainly of the above-exemplified aliphatic dibasic acids with alcohol components composed of linear dihydric alcohols and small amounts of trihydric or tetrahydric alcohols (such as glycerol, trimethylolethane or pentaerythritol) to form polyesters having a relatively low number average molecular weight (generally about 500 to about 10,000, especially 1,000 to 8,000), extending the chain length of these polyesters to 2 to 50 times the original length by reacting them with the above-exemplified diisocyanate compounds, and mixing the resulting urethane-modified polyester resin with polyisocyanate compounds or block polyisocyanate compounds as crosslinking agents. The urethane-modified polyester resins suitably have a hydroxyl value of generally about 20 to about 100, especially 30 to 80. The blocked polyisocyanate compounds may preferably be those in which the blocking agent is dissociated at a temperature of not more than 130° C.

When such a composition containing a blocked polyisocyanate compound is heated to a temperature above the dissociation temperature of the blocking agent for the blocked polyisocyanate compound, usually at a temperature of at least about 60° C., the blocking agent is dissociated and the diisocyanate compound is regenerated. The diisocyanate compound thus reacts with the urethane-modified polyester resin to perform crosslinking and curing reaction. The physical properties of the cured coated film can be easily adjusted by adjusting the molecular chain length of the polyester resin, the hydroxyl group content (i.e., the hydroxyl value), the amount of the polyisocyanate compound, etc.

(6) Modified polyolefinic resins

Examples are a mixture of 100 parts by weight of propylene/ethylene copolymer (preferably propylen-/ethylene mole ratio in the range of from 40:60 to 80:20; number average molecular weight in the range of 10,000 to 700,000 to 20,000 to 500,000) with 1 to 50 parts by weight, preferably 10 to 20 parts by weight, of chlorinated polyolefin (chlorination degree: about 1 to 60%; number average moeecular weight 10,000 to 300,000), and a resin obtained by graft copolymerizing 100 parts of the above propylene/ethylene copolymer with 0.1 to 50 parts by weight, preferably 0.3 to 20 parts by weight, of maleic acid or maleic anhydride.

(7) Styrene/butadiene copolymers

Examples are a copolymer obtained by copolymerizing 1 to 80% by weight, preferably 10 to 40% by weight, of styrene and 99 to 20% by weight, preferably 90 to 60% by weight, of butadiene, and a copolymer obtained by copolymerizing styrene and butadiene with about 1 to about 20% by weight, based on the total amount of styrene and butadiene, of vinylpyridine. These copolymers preferably have a number average molecular weight of generally about 10,000 to about 500,000, especially 20,000 to 300,000.

(8) Polybutadiene

A resin containing cis-1,4-polybutadiene as a main component and optionally containing a trans-1,4-bond or a vinyl bond. The resin has a number average molecular weight of about 10,000 to about 500,000, especially 20,000 to 300,000.

(9) Acrylonitrile/butadiene copolymer

It is a copolymer obtained by copolymerizing 10 to 55% by weight, preferably 10 to 40% by weight, of acrylonitrile and 90 to 45% by weight, preferably 90 to 60% by weight, of butadiene. Also included are copolymers obtained by further copolymerizing 0.5 to 35% by weight, based on the total amount of acrylonitrile and butadiene of a third component such as styrene, acrylic acid, methacrylic acid and vinylpyridine. These copolymers may have a number average molecular weight of about 10,000 to about 500,000, especially 20,000 to 300,000.

(10) Butyl rubber

It is a copolymer of isobutylene and a minor amount (usually 1 to 10% by weight based on the weight of the copolymer) of isoprene. Preferably, it has a number average molecular weight of generally about 10,000 to about 500,000, particularly 20,000 to 300,000.

(11) Acrylic resins

Examples are resin obtained by polymerizing acrylic esters and/or methacrylic esters as a main component and as required a vinyl monomer component composed of a functional monomer such as acrylic acid, methacrylic acid, hydroxyethyl acrylate or a hydroxypropyl methacrylate and/or another polymerizable unsaturated monomer. Examples of especially suitable acrylic esters are $C_1$-$C_{18}$ alkyl esters of acrylic acid such as ethyl acrylate, propyl acrylate, n-butyl acrylate, isobutyl acrylate, 3-pentyl acrylate, hexyl acrylate, 2-heptyl acrylate, octyl acrylate, 2-octyl acrylate, nonyl acrylate, lauryl acrylate, 2-ethylhexyl acrylate and 2-ethylbutyl acrylate. Especially suitable methacrylic esters are $C_5$–$C_{18}$ alkyl esters of methacrylic acid such as pentyl methacrylate, hexyl methacrylate, 2-ethylhexyl methacrylate, decyl methacrylate, lauryl methacrylate, and stearyl methacrylate. Homopolymers derived from the acrylic esters and methacrylic esters exemplified herein have a static glass transition temperature of not more than 0° C. At least one of the acrylic or methacrylic esters exemplified above is suitable as a monomer for forming the acrylic resins. The acrylic resins may usually have a number average molecular weight of about 5,000 to about 1,000,000, especially 1,000 to 500,000.

(12) Other examples of the vehicle component of the barrier coat used in this invention include chloroprene rubber, chlorosulfonated polyethylene, the reaction products of alkylene dihalides (such as ethylene dichloride, ethylene dichloride formal or propylene dichloride) with sodium polysulfide, silicon rubbers (such as dimethylsilicon rubber, methylphenylsilicon rubber, methylvinylsilicon rubber, alkyl fluoride methyl silicon rubber, or cyanoalkylsilicon rubbers), ethylene/propylene rubber, propylene oxide rubber, and epoxy resin-polyamide compositions.

At least one material selected from (1) to (12) may be used as the vehicle component of the barrier coat in this invention, and those selected from (1) to (6) and (11) are especially preferred. It should be understood however that other organic solvent-soluble resins which are not exemplified above but which give coated films having the aforesaid properties and Tg values may be equally used.

The polyisocyanate compounds in the barrier coat may be divided roughly into the following two with regard to their reaction behaviors.

(I) Most or all of the polyisocyanate compound permeates into the cationically electrodeposited film and reacts crosslinkingly with the functional groups of the cationic base resin.

(II) In addition to the crosslinking reaction (I), the polyisocyanate compound also crosslinkingly reacts with the vehicle component in the barrier coat.

In the case of (I), the vehicle component of the barrier coat contains little or no functional group which can react with the isocyanate groups. In this case, when the polyisocyanate compound is incorporated in advance in the barrier coat (one-package type), the mixture does not thicken nor gel. Hence, the handling of the barrier coat is easy and the polyisocyanate compound permeates fully in the cationically electrodeposited film.

In the case of (II), the vehicle component of the barrier coat contains a relatively large amount of functional groups capable of reacting with the isocyanate groups. In this case, the vehicle component and the polyisocyanate compound may react during storage to cause thickening and gellation. Desirably, therefore, the two components are separated (two-package type), and mixed immediately before use (coating). Needless to say, the use of a blocked polyisocyanate obviates the need to store the two components separately.

The amount of the polyisocyanate compound (including the blocked polyisocyanate compound) is preferably 10 to 150 parts by weight, particularly 20 to 100 parts by weight, above all 30 to 70 parts by weight, per 100 parts (as solids) of the vehicle component.

The organic solvent may be any of organic solvents known in paint application which can dissolve or disperse the aforesaid polyisocyanate compound and the vehicle component. Examples include aromatic hydrocarbons such as benzene, toluene and xylene, aliphatic hydrocarbons such as hexane, heptane, octane, decane, chlorinated hydrocarbons such as trichloroethylene, perchloroethylene, dichloroethylene, dichloroethane and dichlorobenzene, ketones such as methyl ethyl ketone and diacetone alcohols, alcohols such as ethanol, propanol and butanol, and Cellosolve-type solvents such as methyl Cellosolve, butyl Cellosolve and Cellosolve acetate.

The barrier coat may contain the same pigment (body pigments, colored pigments, anticorrosive pigments) as described above with regard to the cationic elecrodepositing paint. The amount of the pigment to be added is preferably 1 to 150 parts by weight, particularly 10 to 60 parts by weight, per 100 parts by weight of the vehicle (as solids).

It has been found in particular that by incorporating the anticorrosive pigment in the barrier coat, the corrosion resistance of the resulting composite coated film can be markedly improved over the case of including it in the electrodeposited film.

If in this invention the vehicle component itself can form a coated film having a static glass transition temperature within the above-specified range, it may be used as such as a barrier coat. But when the static glass transition temperature falls outside the specified range, or it is desired to micro-adjust the static glass transition temperature within the specified range, a tackifier may be incorporated as required. The tackifier may be a resin having good compatibility with the vehicle, and examples include rosin, petroleum resins (coumarone resin), ester gum, epoxy-modified polybutadiene, low-molecular-weight aliphatic epoxy resins, low- molecular-weight aliphatic bisphenol-type epoxy resins, polyoxytetramethylene glycol, and vinyl acetate-modified polyethylene. The amount of the tackifier to be incorporated is preferably 1 to 50 parts by weight, particularly 5 to 30 parts by weight, as solids per 100 parts by weight of the vehicle (as solids). It is important that the coated film formed by the barrier coat should have a static glass transition temperature) of 0° to −75° C., preferably −25° to −60° C., especially preferably −40° to −55° C. If Tg becomes higher than 0° C., the chipping resistance, corrosion resistance and physical properties of the final composite coated film are not improved. If, on the other hand, it is lower than −75° C., the water resistance and adhesion of the final coated film are undesirably reduced.

If the tensile break elongation of the barrier coated film itself is adjusted to a range of 200 to 1,000%, especially 300 to 700%, at a pulling speed of 20 mm/min. in an atmosphere kept at +20° C., the chipping resistance and corrosion resistance of the final coated film can further be improved.

The "static glass transition temperature" of the barrier coated film, as used in this invention, is measured by a differential scanning calorimeter (Model DSC-10, made by Daini Seikosha Co., Ltd.). The "tensile break elongation" is measured on a sample having a length of 20 mm at a pulling speed of 20 mm/min. using a universal tensile tester equipped with a consant-temperature vessel (Autograph S-D, made by Shimazu Seisakusho Co., Ltd.). The samples used in these measurements are obtained by coating a barrier coat paint on a tin plate so as to provide a final thickness of 25 microns, baking it at 120° C. for 30 minutes, and thereafter separating the coated film from the plate by a mercury amalgam method.

In the present invention, the barrier coat may be applied after the electrodeposited film is washed with water and dried. There is no particular limitation on the method of coating, and spray coating, brush coating, dip coating and electrostatic coating may be used. The thickness of the coated film is preferably 1 to 20 microns, especially 5 to 10 microns based on the finally formed coated film.

Intermediate coating paint

The intermediate coating paint is a paint which is coated optionally on the surface of the barrier coat film, and may be any of known intermediate coating paints for metals or plastics which have good adhesion, smoothness, distinctness of image glosss, overbake resistance and weatherability. Specific examples are crosslinkable intermediate coating paints comprising an alkyd resin modified with a short oil or ultrashort oil having an oil length of not more than 30% and/or an oil-free polyester resin and an amino resin or a polyisocyanate compound as main components of a vehicle. The alkyd resin and polyester resin preferably have a hydroxyl value of 60 to 140, especially 70 to 120 and an acid value of not more than 300, especially 3 to 50, and contain an unsaturated oil (or an unsaturated fatty acid) as a modifying oil. Suitable amino resins are, for example, alkyl(preferably $C_1$-$C_5$)-etherified melamine resins, urea resins, and benzoguanamine resins. The proportions of blending these two resins based on solids are preferably 65 to 85%, especially 70 to 80%, for the alkyd resin and/or the oil-free polyester resin, and 35 to 15%, especially 30 to 20%, for the amino resin. Furthermore, at least a part of the amino resin may be replaced by a polyisocyanate compound or a blocked polyisocyanate compound of the type described hereinabove.

The form of the intermediate coating paint is mostly preferably an organic solvent solution, but may also be a non-aqueous dispersion type, a high-solid type, an aqueous solution type or an aqueous dispersion type using the above vehicle component. Preferably, the hardness (pencil hardness) of the intermediate coated film is preferably harder than 3B, preferably 3B to 6H (20° C.) As required, a body extender pigment, a colored pigment and other paint additives may be incorporated in the intermediate coating paint. The intermediate coating paint may be applied to the surface of the barrier coat film by the same method as in the application of the barrier coat. The thickness of the coated film is preferably 10 to 80 microns, and especially 20 to 40 microns, based on the cured film. The method of curing the coated film differs depending upon the type of the vehicle component. It may be cured at ordinary temperatures. Preferably, the coated film is cured by heating at a temperature of, for example, 60° to 130° C. It may be cured by irradiation of electron beams or actinic light.

Top coat paint

It is a paint to be coated on the surface of the barrier coat film or the surface of the intermediate coated film. It may be any of known paints which can impart aesthetic surface characteristics (vividness, smoothness, gloss, etc.) weatherability (gloss retention, color retention and chalking resistance), chemical resistance, water resistance, moisture resistance and curability. For example, it includes paints comprising as a vehicle component composed of an acrylic resin, an alkyd resin, a polyester resin, etc. as a base resin and as required, a crosslinking agent such as an amino resin, a polyisocyanate compound or a vinyl monomer. Of these, paints containing an amino-acrylic resin-tyep vehicle or an amino-alkyd resin type vehicle are preferred. The form of the top coat paint is not particularly limited, and may be an organic solvent solution, a nonaqueous dispersion, an aqueous dispersion or solution, or a high-solid type. Drying or curing of the top coat film may be carried out by drying at ordinary or elevated temperatures, irradiation of actinic energy rays, etc. depending upon the vehicle component.

The cured film of the top coat has a pencil hardness of usually 2B or higher, especially 2H to 9H at 20° C. This increases the scratch resistance of the coated film, and since the energy of impact by crushed stones on the surface of the coated film is not concentrated but dispersed, the chipping resistance of the final coated film is further improved.

The top coat paint used in this invention may be an enamel paint comprising a paint composed of the above vehicle as a main component and a metallic pigment and/or a colored pigment, or a clear paint completely or substantially free from such a pigment. The top coat may be formed by the followng methods.

(1) A metallic paint containing a metallic pigment and as required a colored pigment, or a solid color paint containing a colored pigment is coated and curred under heat (metallic or solid color finishing by a one coat-one bake method).

(2) The metallic paint or the solid color paint is coated, and cured under heat. Furthermore, the clear paint is coated, and again cured under heat (metallic or solid color finishing by a two coat-two bake method).

(3) The metallic paint or the solid color paint is coated and then the clear piant is coated. The coated films are heated to cure them simultaneously (metallic or solid color finishing by a two coat-one bake method).

Preferably, these top coat paints are applied by spray coating or electrostatic coating. The thickness of the coated film on drying is preferably, 25.to 40 microns in the case of (1). In the case of (2) and (3), the coated film from the metallic or solid color paint is preferably 10 to 30 microns, and the coated film from the clear paint is preferably 25 to 50 microns. The temperature for curing may be selected depending upon the vehicle component, but generally, it is lower than the heat distortion temperature of the plastic material. For example, the coated film is heated at about 60° to about 130° C., especially 80 to 120, for 10 to 40 minutes.

The "pencil hardness" of the film and the top coat is measured by using a test plate on which the surface or the top coat paint is coated and cured to a film thickness of 30 microns. The test plate is maintained at 20° C., and a pencil having a sharpened core tip ("Unit" for drafting made by Mitsubishi Pencil Co., Ltd.) is held at an angle of 45° C. While the pencil is pressed against the coated surface with such a strength as not to break the pencil core, it is moved about 1 cm (3 seconds/cm). Pencils of various hardnesses are used, and the hardness of the hardest pencil which does not leave a trace of the pencil scratch is determined and defined as the pencil hardness of the coated film.

The following Examples and Comparative Examples illustrate the present invention more specifically. All parts and percentages in these examples are by weight.

I. Preparation of samples (1) Substrate

A steel sheet (size 300 ×90 ×0.8 mm) chemically treated with Bondelite #2030 (zinc phosphate-type metal surface reating agent made by Nihon Parkerizing Co., Ltd.).

(2) Cationic electrodepositing paint (A) A cationic electrodepositing paint having a solids content of 20% and obtained by mixing 100 parts (as solids) of a hydroxyl-containing cationic resin obtained by the reaction of 5 moles of a diglycidy ether of bisphenol A, 4 moles of bisphenol A and 0.4 mole of a dimethylethanolamine lactate, 20 parts of titanium white, 0.5 part by weight of carbon black and 7 parts of clay.

(B) A cationic electrodepositing paint having a solids content of 20% prepared by heating 227 parts of epoxy cresol novolak (epoxy equivalent 4.4, softening point 82° C.) and 132 parts of p-nonylphenol, melt-mixing them, adding 0.05 part of 2-phenylimidazole as a catalyst, heating the mixture to 160° C. to react it to an epoxy equivalent of 1.5, adding 205 parts of bisphenol A, reacting the mixture at 140° C. until the epoxy equivalent of the reaction mixture becomes substantially zero, adding 380 parts of a diglycidyl ether of bisphenol A and 71.5 parts of a methyl isobutyl ketone ketimine of monoethanolamine, reacting the mixture at the same temperature as above until the decrease of the epoxy groups stops, adding 203 parts of ethylene glycol monobutyl ether and 20 parts of 2-ethylhexanol to dilute the reaction mixture, cooling the reaction mixture, then adding 1.5 parts of acetic acid to 122 parts of the resulting reaction product to protonize it, and diluting the protonized product with water.

(C) 228 parts of a diglycidyl ether of bisphenol A and 55 parts of polycaprolactone diol (molecular weight 550) were heated and mixed and 0.7 part of dimethylbenzylamine was added as a catalyst. The mixture was reacted at 160° C. until the epoxy equivalent of the reaction mixture became 3.5. Then, 91.2 parts of bisphenol A was added, and the mixture was reacted at 130° C. until the epoxy equivalent of the mixture became 0.53. Then, 74.8 parts of ethylene glycol monobutyl eher, 11.2 parts of benzyl alcohol and 15 parts of methyl ethanolamine were added, and the reaction was carried out at 90° C. until the tertiary amine value of the reaction mixture became 28.8.

123 parts of the reaction product was protonized with 1.1 parts of acetic acid, and diluted with water to form an aqueous dispersion having a solids of 30%.

A pigment paste composed of 20 parts of titanium white, 0.3 part of carbon black, 0.5 part of a polyoxyethylene nonylphenyl ether type nonionic surfactant having an HLB of 14, 6.2 parts of the above reaction product, 0.11 part of acetic acid and water was added to the aqueous dispersion to prepare a cationic electrodepositing paint having a solids content of 22%.

(D) Elecron #9200 (a tradename for a cationic electrodepositing paint of the epoxypolyamide/blocked isocyanate type made by Kansai Paint Co., Ld.).

(3) Barrier coat (A) A toluene solution of a composition composed of 100 parts of vinyl acetate/ethylene copolymer (number average molecular weight: about 8,000; tensile break elongation: 600%; static glass transition temperature: −43° C.) and 50 parts of hexamehylene diisoperature.

(B) A paint prepared by adding 100 parts of hexamethylene diisocyanate to a toluene/methyl ethyl ketone (8/2) solution of 100 parts of Vylon 300 (a tradename for a thermoplastic high-molecular-weight linear saturated polyester resin made by Toyobo Co., Ltd.; tensile break elongation: 600%, static glass transition temperature: −28° C.; number average molecular weight: about 18,000 to about 20,000).

(C) Acrylic resin

A solution in toluene/xylene of a composition composed of 100 parts of a copolymer derived from ethyl acrylate, hexyl acrylate and a small amount of acrylic acid and having a number average molecular weight of about 15,000 and 60 parts of lysine diisocyanate (the resulting coated film having a tensile break elongation of 500% and a static glass transition temperature of −48° C.).

(D) A paint prepared by adding 30 parts of the reaction product of hexamethylene diisocyanate and water to an organic solvent solution of 100 parts of a graft resin composed of 100 parts of propylene/ethylene copolymer (mole ratio 70/30, number average molecular weight about 200,000) and 10 parts of maleic acid grafted thereto (the resulting coated film having a static glass transition temperature of 3141° C. and a tensile break elongation of 400%).

(E) An organic solvent solution of a composition composed of 100 parts of a copolymer (static glass transition temperature: +6° C.)) composed of 60% of hexadecyl acrylate, 25% of 2-ethylhexyl acrylate and 15% by weight of methyl acrylate and 60 parts of hexamethylene diisocyanate.

(F) A composition resulting from exclusion of hexamethylene diisocyanate from the barrier coat (A) above.

(4) Intermediate coating paint (A) Short oil alkyd resin paint

A Intermediate coating paint prepared by adding 100 parts of pigments (titanium white and barite) to 100 parts by weight of a vehicle component composed of 75% of a soybean oil-modified alkyd resin (oil length: 15%, hydroxyl value: 80, acid value: 15) containing mainly phthalic anhydride and terephthalic acid as a polybasic acid component.

(5) Top coat paint (A) Magicron Black a tradename for an aminoacrylic resin type top coat paint made by Kansai Paint Co., Ltd.; a black paint for one coat one bake; pencil hardness 3H (20° C.)].

(B) Magicron Silver a tradename for an aminoacrylic resin type top coat paint made by Kansai Paint Co., Ltd.; a silver meallic paint for two coat one bake; pencil hardness H (20° C.)].

(C) Magicron Clear a tradename for an aminoacrylic resin type top coat paint made by Kansai Paint Co., Ltd.; a clear paint for two coat one bake; pencil hardness H (20° C.)].

II. Examples and Comparative Examples

Each of the paints was coated on the substrate and cured in accordance with the process shown in Table 1.

Cationic electrodeposition was carried out using a bath of the electrodeposition paint kept at 30° C. and a pH of 6.5 at a voltage of 300 V for a current passing time of 3 minutes. After electrodeposition, the coated film (thickness 15 microns after curing) was washed with water.

Then, the barrier coat was applied to the surface of the cationic electrodeposition film by an air spraying method. Furthermore, the intermediate coating paint and the top coat paint were coated by an electrostatic coating technique under the conditions shown in Table 1. The film thicknesses were those after curing.

In top coating, "1C1B" means a coating system in which the top coat paint A was applied, and then baked at 120° C. for 30 minutes; and "2C1B" means a coating system in which the top coat paints B and C were applied overlappingly wet-on-wet, and then baked at 120° C. for 30 minutes to cure the two films simultaneously.

III. Method and results of testing properties

The coated sheets obtained in the above Examples and Comparative Examples were tested for properties. The results are shown in Table 2.

[Testing Methods]

1. Chipping resistance (1) Testing device

Q-G-R gravelometer (a product of Q Panel Co., Ltd.)

(2) Crushed stones to be air-blasted: crushed stones having a diameter of about 15 to 20 mm (3) Volume of the crushed stones to be airblasted: about 500 ml (4) Blasting air presure: about 4 kg/cm$^2$ (5) Temperature at the time of testing: about 20° C.

The test sheet was fixed on a test piece holder, and about 500 ml of the crushed stones were impinged against the top coat of the test sheet at an air blasting pressure of about 4 kg/cm$^2$, and thereafter, the condition of the coated surface and the salt spray resistance of the coated film were evaluated.

The condition of the coated surface was evaluated by visual observation o the following standards. The salt spray resistance was carried out by subjecting the test sheet to a salt spray test for 960 hours in accordance with JIS Z2371. Then, an adhesive cellophane tape was applied to the coated surface and abruptly peeled. Thereafter, the presence of rust, the corroded condition and film peeling, etc. at that part which was under the impact of collision were examined.

(1) Conditon of the coated surface

◎(good): very slight scratch was noted on a part of the top coat, and no peeling of the electrodeposited film was noted.

Δ (slightly poor): many scratches and peelings by impact were observed on the top coat and the intermediate coated film, and peeling was noted here and there in the electrodeposited film.

X (poor): most of the top coat and the intermediate coated film were peeled, and the electrodeposited film at the impact part and its neighborhood was peeled.

(2) Salt spray resistance

◎: No rusting, corrosion and film peeling were noted.

○: Some rusting, corrosion and film peeling were noted.

Δ: Relatively much rusting, corrosion and film peeling were noted.

X : Rusting, corrosion and film peeling occurred markedly.

2. Imapct strength

This test was carried out in accordance with JIS K5400-1979 6.1 3.3 in a atmosphere kept at 0° C. A weight of 500 g was let fall from a height of 50 cm, and the damage of the coated film was examined.

◎: No change

Δ: Much cracking and peeling occurred

X: Cracking and peeling markedly occurred

3. Adhesion In accordance with JIS k5400-1979 6.15, 100 squares having a size of 1 x 1 mm were provided on the coated film. an adhesive cellophane tape was applied to the surface of these squares, and abruptly peeled. The number of remaining squares was examined.

4. Water resistance The sample was immersed in water at 40° C. for 10 days, and then the coated surface was evaluated.

◎: No change

X : Blisters occurred

5. Scratch resistance

Four cheese cloths were placed on the coated surface of the test sheet maintained horizontal at 20° C., and a weight of 1 kg (having a diameter of 5 cm with a flat bottom for use in an upper plate-type balance). The ends of the cheese cloths were held and caused to reciprocate over the test sheet at a rate of 20 cm/sec through 20 reciprocations. Then, the condition of the coated surface was evaluated.

◎: Scratching hardly occurred

Δ:Relatively much scratching occuured

X : Considerable scratching occurred

TABLE 1

| | | Example | | | | | | | | | | | | | |
|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 |
| Cationic electro-deposition | Paint | (A) | | | | (B) | | (C) | | (A) | | (B) | | (C) | |
| Cured film thickness 15μ | Curing conditions | 60° C. 30 min. | | | | | | | | | | | | | |
| Barrier coating | Paint | (A) | (B) | (C) | (D) | (A) | (B) | (C) | (D) | (A) | (B) | (A) | (B) | (C) | (D) |
| Cured film thickness 8μ | Baking conditions | 120° C. 30 min. | | | | | | | | | | | | | |
| Intermediate coating | Paint | — | | | | | | | | (A) | | | | | |
| Cured film thickness 25μ | Baking conditions | — | | | | | | | | 120° C. 30 min. | | | | | |
| Top coating | System | 1C1B | | 2C1B | | 1C1B | | 2C1B | | 2C1B | | | | | |
| | Paint | (A) | | (B) | | (A) | | (B) | | (B) | | | | | |
| | Film thickness (μ) | 30 | | 15 | | 30 | | 15 | | 15 | | | | | |
| | Paint | | | (C) | | | | (C) | | (C) | | | | | |
| | Film thickness (μ) | | | 35 | | | | 35 | | 35 | | | | | |
| | Baking conditions | 120° C. 30 min. | | | | | | | | | | | | | |

| | | Comparative Example | | | | | | | |
|---|---|---|---|---|---|---|---|---|---|
| | | 1 | 2 | 3 | 4 | 5 | 6 | 7 | 8 |
| Cationic electro-deposition | Paint | (A) | (B) | (C) | (D) | | (A) | (B) | (C) |
| Cured film thickness 15μ | Curing conditions | 60° C. 30 min. | | | | | | | |
| Barrier coating | Paint | — | | (F) | | | (E) | | |
| Cured film thickness 8μ | Baking conditions | — | | 120° C. 30 min. | | 170° C. 30 min. | 120° C. 30 min. | | |
| Intermediate coating | Paint | — | | | | (A) | | | |
| Cured film thickness 25μ | Baking conditions | 120° C. 30 min. | | | | | | | |
| Top coating | System | 1C1B | | | | 2C1B | | | |
| | Paint | (A) | | | | (B) | | | |
| | Film thickness (μ) | 30 | | | | 15 | | | |
| | Paint | | | | | (C) | | | |
| | Film thickness (μ) | | | | | 35 | | | |
| | Baking conditions | 120° C. 30 min. | | | | | | | |

TABLE 2

| | Example | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |

TABLE 2-continued

| | | | | | | | | | | | | | | |
|---|---|---|---|---|---|---|---|---|---|---|---|---|---|---|
| Chipping resistance | Condition of the coated surface | ◎ | ◎ | ◎ | ◎ | ◎ | ◎ | ◎ | ◎ | ◎ | ◎ | ◎ | ◎ | ◎ |
| | Salt spray resistance | ◎ | ◎ | ◎ | ◎ | ◎ | ◎ | ◎ | ◎ | ◎ | ◎ | ◎ | ◎ | ◎ |
| Impact resistance | | ◎ | ◎ | ◎ | ◎ | ◎ | ◎ | ◎ | ◎ | ◎ | ◎ | ◎ | ◎ | ◎ |
| Adhesion | | 100 | 100 | 100 | 100 | 100 | 100 | 100 | 100 | 100 | 100 | 100 | 100 | 100 |
| Water resistance | | ◎ | ◎ | ◎ | ◎ | ◎ | ◎ | ◎ | ◎ | ◎ | ◎ | ◎ | ◎ | ◎ |
| Scratch resistance | | ◎ | ◎ | ○ | ○ | ◎ | ◎ | ○ | ○ | ○ | ○ | ○ | ○ | ○ |

| | | Comparative Example | | | | | | | |
|---|---|---|---|---|---|---|---|---|---|
| | | 1 | 2 | 3 | 4 | 5 | 6 | 7 | 8 |
| Chipping resistance | Condition of the coated surface | X | X | X | X | ◎ | Δ | Δ | Δ |
| | Salt spray resistance | X | X | X | X | ◎ | X | X | X |
| Impact resistance | | X | X | X | X | ◎ | Δ | Δ | Δ |
| Adhesion | | | | | | 100 | 100 | 100 | 100 |
| Water resistance | | X | X | X | X | ◎ | ◎ | ◎ | ◎ |
| Scratch resistance | | ◎ | ◎ | ○ | Δ | ○ | ○ | ○ | ○ |

What is claimed is:

1. A process for forming a composite coated film, which comprises coating a cationically electrodepositing paint film on the surface of a substrate, said electrodepositing paint being composed mainly of a cationic resin having a functional group capable of reacting with isocyanate groups and substantially free from a crosslinking agent, then coating an organic solvent-base paint containing a polyisocyanate compound having per molecule at least two isocyanate groups which is partly or fully blocked with a blocking agent capable of being dissociated at a temperature of not more than 130° C., said solvent-based paint being capable of forming a coated film having a static glass transition temperature of 0° to −75° C. on the surface of the coated electrodepositing paint film, and then coating a top coat paint thereupon.

2. The process of claim 1 wherein the functional group capable of reacting with isocyanate groups is selected from the group consisting of a hydroxyl group, a primary amino group and an imino group.

3. The process of claim 1 wherein the amount of the functional group capable of reacting with isocyanate groups is 1 to 20 equivalents per 1,000 g of the cationic resin.

4. The process of claim 1 wherein the cationic resin is a resin obtained by reacting an epoxy resin with a cationizing agent.

5. The process of claim 4 wherein the epoxy resin is obtained by reacting bis(4-hydroxyphenyl)-2,2-propane or phenol novolak with epichlorohydrin.

6. The process of claim 4 wherein the cationizing agent is a basic amino compound.

7. The process of claim 6 wherein the basic amino compound is selected from the group consisting of lower alkanolamines, di-lower alkanolamines and N-lower alkyl-lower alkanolamines.

8. The process of claim 1 wherein the cationic resin has a stationary glass transition temperature of about 50° to about 130° C.

9. The process of claim 1 wherein the cationic resin has a number average molecular weight of 3,000 to 30,000.

10. The process of claim 1 wherein the cationic resin contains cationized groups in an amount corresponding to a base value of about 3 to 30.

11. The process of claim 1 wherein the polyisocyanate compound is selected from the group consisting of a reaction product of hexamethylene diisocyanate and water, an adduct of xylylene diisocyanate and trimethylolpropane, an adduct of tolylene diisocyanate and hexamethylene diisocyanate, isophorone diisocyanate, hexamethylene diisocyanate and lysine diisocyanate.

12. The process of claim 1 wherein a coated film formed from the organic solvent-base paint has a stationary glass transition temperature of −25° to −60° C.

13. The process of claim 1 wherein the organic solvent-base paint contains a vehicle component selected from the group consisting of a vinyl acetate/ethylene copolymer, a linear saturated polyester resin, a thermoplastic polyurethane elastomer, a polybutadiene-containing crosslinkable resin composition, a thermosetting polyester resin composition, a modified polyolefin resin and an acrylic resin.

14. The process of claim 1 wherein the organic solvent-base paint contains an anticorrosive paint.

15. The process of claim 1 wherein a coated film prepared from the organic solvent-base paint has a tensile break elongation, measured at a pulling speed of 20 mm/min. in an atmosphere kept at +20° C., of 200 to 1,000%.

16. The process of claim 1 wherein a coated film prepared from the organic solvent-base paint has a thickness of 1 to 20 microns.

17. The process of claim 1 wherein an intermediate coating paint is applied to the coated film obtained from the organic solvent-base paint and then the top coat is painted on the intermediate coated paint film.

18. The process of claim 17 wherein the intermediate coating paint is a thermosetting intermediate coating paint of the organic solvent type or aqueous type containing as a main vehicle component, a combination of (1) a short oil or ultrashort oil alkyd resin having an oil length of 30% or less or an oil-free polyester resin or mixture thereof and (2) an amino resin.

19. The process of claim 17 wherein a film formed from the intermediate coating paint has a pencil hardness of 3B to 6H at 20° C.

20. The process of claim 17 wherein a film formed from the intermediate coating paint has a thickness of 10 to 50 microns after curing.

21. The process of claim 1 wherein the top coat paint is a top coat paint of the amino-acrylic resin type or the amino-alkyd resin type.

22. The process of claim 1 wherein the composite coated film has a pencil hardness of 2H to 9H at 20° C. after curing.

23. A metallic substrate coated according to the process of claim 1.

* * * * *